US010864140B2

(12) United States Patent
Kikuchi et al.

(10) Patent No.: US 10,864,140 B2
(45) Date of Patent: Dec. 15, 2020

(54) MEDICINE FEEDING APPARATUS AND MEDICINE PASSING APPARATUS

(71) Applicant: Takazono Technology Incorporated, Hirakata (JP)

(72) Inventors: Hideyuki Kikuchi, Hirakata (JP); Teruaki Satoh, Hirakata (JP); Takanori Yamabayashi, Hirakata (JP)

(73) Assignee: Takazono Technology Incorporated, Osaka (JP)

( * ) Notice: Subject to any disclaimer, the term of this patent is extended or adjusted under 35 U.S.C. 154(b) by 147 days.

(21) Appl. No.: 15/738,222

(22) PCT Filed: Jun. 30, 2016

(86) PCT No.: PCT/JP2016/069433
§ 371 (c)(1),
(2) Date: Dec. 20, 2017

(87) PCT Pub. No.: WO2017/002914
PCT Pub. Date: Jan. 5, 2017

(65) Prior Publication Data

US 2018/0185242 A1 Jul. 5, 2018

(30) Foreign Application Priority Data

Jul. 2, 2015 (JP) ..... 2015-133719

(51) Int. Cl.
*B65B 9/04* (2006.01)
*B65B 39/00* (2006.01)
(Continued)

(52) U.S. Cl.
CPC ..... *A61J 3/00* (2013.01); *B65B 1/06* (2013.01); *B65B 9/042* (2013.01); *B65B 9/045* (2013.01);
(Continued)

(58) Field of Classification Search
CPC ..... B65B 1/06; B65B 9/045; B65B 39/00; B65B 39/005; B65B 39/007; B65B 39/12
(Continued)

(56) References Cited

U.S. PATENT DOCUMENTS 2,761,607 A * 9/1956 Ayars ..... B67C 3/2637 141/147
8,991,442 B1 3/2015 Navin et al.

FOREIGN PATENT DOCUMENTS

CN 201873007 U 6/2011
CN 202138566 U 2/2012
(Continued)

*Primary Examiner* — Paul J Gray
(74) *Attorney, Agent, or Firm* — The Webb Law Firm

(57) ABSTRACT

Provided is a medicine feeding apparatus including: a medicine feeder body configured to feed medicine; and a medicine passage configured to guide the medicine fed by the medicine feeder body to a packaging material configured to package the medicine. The medicine passage includes: an inlet that is configured to allow the medicine to enter from above therethrough; an outlet that is configured to allow the medicine to exit downward therethrough; and a communication part that is configured to communicate the inlet and the outlet with each other. The inlet and the outlet are provided as separate bodies from each other. The communication part is provided as a separate body from the inlet and the outlet and is connected to the inlet and the outlet so as to be positionally adjustable.

5 Claims, 4 Drawing Sheets

(51) Int. Cl.

| | |
|---|---|
| ***B65B 39/12*** | (2006.01) |
| ***A61J 3/00*** | (2006.01) |
| ***B65B 59/04*** | (2006.01) |
| ***B65B 1/06*** | (2006.01) |
| ***B65B 59/00*** | (2006.01) |
| *B65B 1/30* | (2006.01) |
| *B65B 61/02* | (2006.01) |
| *B65B 47/04* | (2006.01) |

(52) U.S. Cl.
CPC ..... *B65B 39/00* (2013.01); *B65B 39/005* (2013.01); *B65B 39/007* (2013.01); *B65B 39/12* (2013.01); *B65B 59/001* (2019.05); *B65B 59/04* (2013.01); *B65B 1/30* (2013.01); *B65B 47/04* (2013.01); *B65B 61/02* (2013.01); *B65B 2220/14* (2013.01)

(58) Field of Classification Search
USPC ..... 141/177, 182, 266, 284
See application file for complete search history.

(56) References Cited

FOREIGN PATENT DOCUMENTS

| | | | |
|---|---|---|---|
| JP | 5420260 | U1 | 2/1979 |
| JP | 58112667 | A | 7/1983 |
| JP | 1118833 | U | 8/1989 |
| JP | 649385 | Y2 | 12/1994 |
| JP | 710102 | A | 1/1995 |
| JP | 2004268991 | A | 9/2004 |
| JP | 2005206219 | A | 8/2005 |
| JP | 2008285226 | A | 11/2008 |
| WO | 2015011764 | A1 | 1/2015 |

* cited by examiner

MEDICINE FEEDING APPARATUS AND MEDICINE PASSING APPARATUS

CROSS-REFERENCE TO RELATED APPLICATIONS

This application is the United States national phase of International Application No. PCT/JP2016/069433 filed Jun. 30, 2016, and claims priority to Japanese Patent Application No. 2015-133719 filed Jul. 2, 2015, the disclosures of which are hereby incorporated in their entirety by reference.

FIELD

The present invention relates to a medicine feeding apparatus configured to feed medicine, or to a medicine passing apparatus configured to allow medicine to pass therethrough.

BACKGROUND

There is a medicine feeding apparatus provided in a tablet packing machine disclosed, for example, in Patent Literature 1. This medicine feeding apparatus includes a medicine passage (medicine passing apparatus) configured to allow medicine to pass therethrough.

In such a medicine passage, if there is an undesired gap, medicine may leak from the medicine passage through the gap. Such leakage of medicine is not preferable because, for example, it makes it impossible to package the medicine as prescribed. Therefore, in the case where the medicine passage is composed of a plurality of components, the distances among the plurality of components need to be strictly adjusted so as not to allow formation of such an undesired gap. However, the work to adjust the distances among the plurality of components takes time and labor.

CITATION LIST

Patent Literature

Patent Literature 1: JP H7-010102 A

SUMMARY

Technical Problem

It is therefore an object of the present invention to provide a medicine feeding apparatus or a medicine passing apparatus which can reduce the time and labor required for the work to adjust the distances among a plurality of components of the medicine passage.

Solution to Problem

A medicine feeding apparatus according to an example of the configuration of the present invention includes: a medicine feeder body configured to feed medicine; and a medicine passage configured to guide the medicine fed by the medicine feeder body to a packaging material configured to package the medicine, wherein the medicine passage includes: an inlet that is arranged below the medicine feeder body and is configured to allow the medicine fed by the medicine feeder body to enter from above therethrough; an outlet that is arranged below the inlet and above the packaging material and is configured to allow the medicine fed by the medicine feeder body to exit downward therethrough; and a communication part that is configured to communicate the inlet and the outlet with each other, the inlet and the outlet are provided as separate bodies from each other, and the communication part is provided as a separate body from the inlet and the outlet and is connected to the inlet and the outlet so as to be positionally adjustable.

Further, a medicine passing apparatus according to an example of the configuration of the present invention is a medicine passing apparatus configured to allow medicine to pass therethrough, the medicine passing apparatus including: an inlet that is configured to allow the medicine to enter from above therethrough; an outlet that is arranged below the inlet and is configured to allow the medicine to exit downward therethrough; and a communication part that is configured to communicate the inlet and the outlet with each other, wherein the inlet and the outlet are provided as separate bodies from each other, and the communication part is provided as a separate body from the inlet and the outlet and is connected to the inlet and the outlet so as to be positionally adjustable.

The configuration can be such that the communication part is vertically movable and is connected to the outlet while being supported from below by the outlet in an area within the vertically movable range.

The configuration can be such that the communication part is hung from the inlet.

The configuration can be such that the communication part is detachably attached to the outlet, and the outlet is detachably attached to a specific position above the packaging material independently of the communication part.

The configuration can be such that the communication part is loosely fitted to the inlet from the outside so as to be connected and is loosely fitted to the outlet from the inside so as to be connected.

The configuration can be such that the medicine passage of the communication part is located outwardly of the medicine passage of the inlet in the connecting portion between the inlet and the communication part, and the medicine passage of the outlet is located outwardly of the medicine passage of the communication part in the connecting portion between the communication part and the outlet.

DESCRIPTION OF EMBODIMENTS

Next, the present invention will be described with reference to an embodiment of a medicine packaging apparatus including a medicine feeding apparatus and a medicine passing apparatus. A medicine packaging apparatus 1 of this embodiment is an apparatus configured to form a medicine package P by automatically packaging medicine M using a packaging sheet 3 and a cover sheet 4 that are packaging materials for packaging the medicine M.

Figure 1:
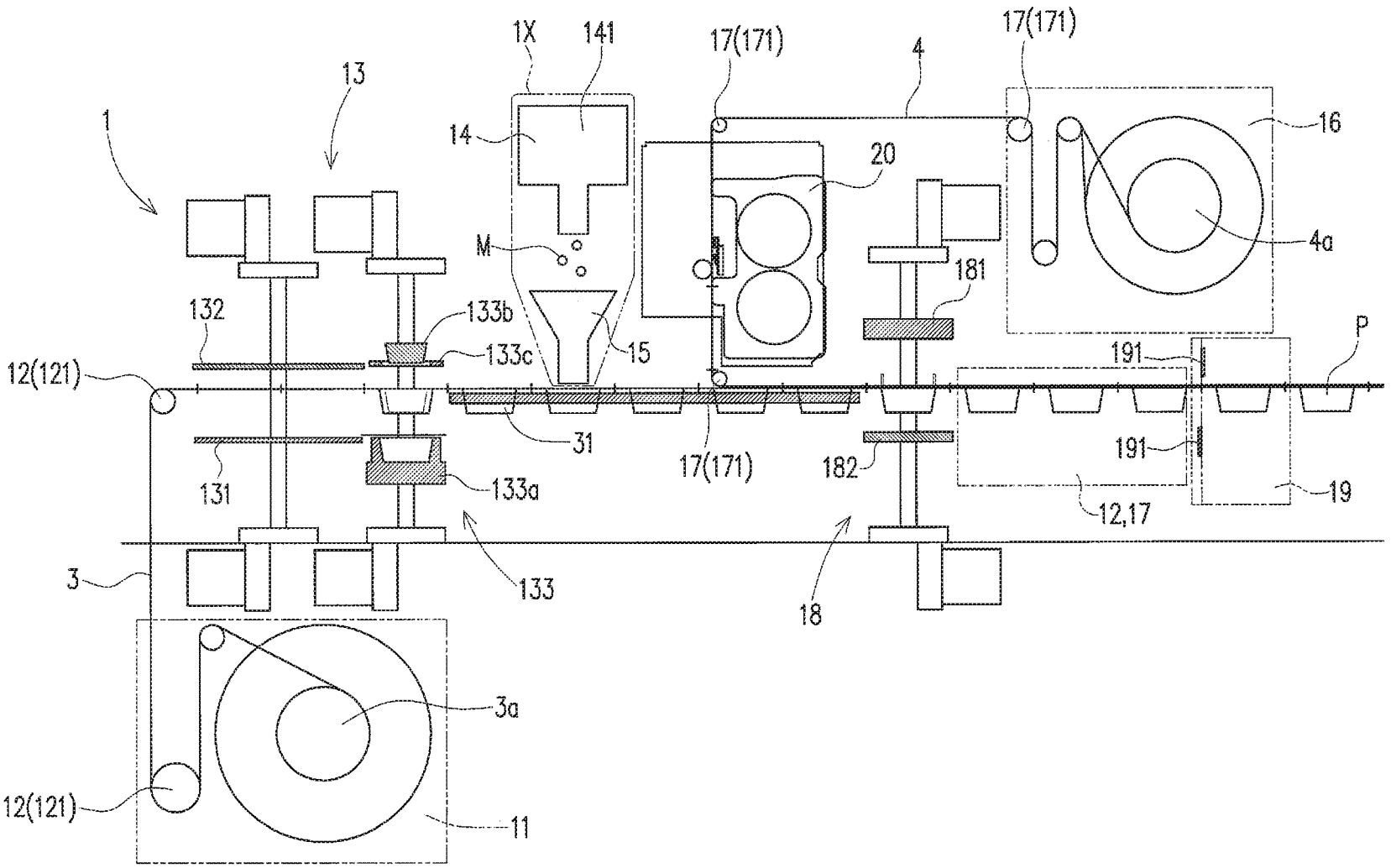
FIG. 1 is a diagram schematically showing a configuration of a medicine packaging apparatus according to an embodiment of the present invention.

As shown in FIG. 1, the medicine packaging apparatus 1 includes a packaging sheet holder 11, a packaging sheet feeder 12, a recess former 13, a medicine feeder body 14, a medicine passage 15, a cover sheet holder 16, a cover sheet feeder 17, a cover sheet bonding unit 18, a cutter 19, and a printer 20. The respective parts are controlled by a control unit, which is not shown.

The packaging sheet holder 11 holds the packaging sheet 3 that is flat. The packaging sheet 3 is a resin sheet. As the packaging sheet 3 of this embodiment, a thermoplastic resin sheet is used, for example. The packaging sheet 3 has an elongated strip shape and is held by the packaging sheet holder 11 so as to be drawable while being wound into a rolled body 3*a*. The width dimension of the packaging sheet 3 is a dimension that allows one recess 31 to be formed therein. The flat packaging sheet 3 is not limited to those having an elongated strip shape. The configuration can be such that the flat packaging sheet 3 has a (short) quadrangular shape in planar view, and a plurality of packaging sheets 3 are stacked in the packaging sheet holder 11. Further, the packaging sheet 3 of this embodiment is transparent. Therefore, it is easy to visually recognize from the outside the medicine M contained in the recess 31 after being packaged. In this embodiment, the transparent packaging sheet 3 is used, but the packaging sheet 3 is not necessarily transparent. The packaging sheet 3, for example, may be semi-transparent or may be opaque.

Since the flat packaging sheet 3 can be used in this embodiment, the medicine packaging apparatus 1 can be configured so that the packaging sheet 3 wound into a roll is held by the packaging sheet holder 11, or a large number of packaging sheets 3 having a quadrangular shape in planar view are stacked and held by the packaging sheet holder 11. That is, the medicine packaging apparatus 1 can hold the packaging sheet(s) 3 in the packaging sheet holder 11, in an amount that allows a large number of medicine packages P to be formed at a time. Therefore, there is no need to set trays having housing recesses one by one by hand as in conventional techniques. The operator of the medicine packaging apparatus is thus relieved of the troublesome work. The word "flat" includes an embodiment in which projections and recesses or patterns are formed without hindering the formation of the recess 31 by the recess former 13, which will be described below.

The packaging sheet feeder 12 takes the packaging sheet 3 out of the packaging sheet holder 11 and feeds the packaging sheet 3 in the longitudinal direction. The packaging sheet 3 is fed while the tension is adjusted by a plurality of rollers 121 as shown in the figure. The packaging sheet 3 is drawn by a transport device (not shown) provided immediately upstream of the cutter 19, which will be described below. Therefore, the packaging sheet 3 is taken out of the packaging sheet holder 11. The feeding of the packaging sheet 3 is stopped when the recess 31 is formed in the packaging sheet 3 by a forming mold 133, which will be described below. Therefore, the feeding is intermittently carried out. Since the medicine M can be put into the packaging sheet 3 automatically fed by the packaging sheet feeder 12 after molding the packaging sheet 3, the medicine M can be packaged easily. As a device for taking out the packaging sheet 3, a device, for example, configured to sandwich and draw the packaging sheet 3 can be employed and various devices such as rollers, arms, and rubber plates can be employed. In particular, in the case of using the packaging sheets 3 having a quadrangular shape in planar view, the packaging sheet feeder 12 is configured so as to be capable of taking the packaging sheets 3 out of the packaging sheet holder 11 one by one.

The recess former 13 forms a plurality of the recesses 31 in the packaging sheet 3 fed by the packaging sheet feeder 12 at specific intervals in the longitudinal direction. The recess former 13 includes a hot plate 131, a receiving part 132, and the forming mold 133.

The hot plate 131 and the receiving part 132 are opposed to each other with the conveyed packaging sheet 3 being interposed therebetween, and their opposed surfaces are flat. The hot plate 131 is located below the packaging sheet 3, and the receiving part 132 is located thereabove. The hot plate 131 and the receiving part 132 may be inversely arranged with respect to the packaging sheet 3. A heater is incorporated in the hot plate 131. The receiving part 132 is made of resin and is made of rubber in this embodiment. The receiving part 132 may serve as another hot plate in which a heater is incorporated. The hot plate 131 and the receiving part 132 are configured to be capable of moving close to and away from the packaging sheet 3 by being driven by an electric motor. The driving source to drive the hot plate 131 and the receiving part 132 is not limited to the electric motor. The driving source of the hot plate 131 and the receiving part 132 may be any device that can cause the hot plate 131 and the receiving part 132 to move close to and away from the packaging sheet 3. The driving source of the hot plate 131 and the receiving part 132 may be, for example, an air cylinder or a hydraulic cylinder. The hot plate 131 and the receiving part 132 move close to the packaging sheet 3 so as to sandwich the packaging sheet 3, while the hot plate 131 is heated by energizing the heater, thereby softening the packaging sheet 3.

The hot plate 131 and the receiving part 132 are formed to have a dimension of two packages (equivalent to two recesses 31) in the longitudinal direction. Meanwhile, the packaging sheet 3 intermittently moves so that the recess 31 is formed for each package (equivalent to one recess 31) by the forming mold 133. With such intermittent movement, the packaging sheet 3 is fed to the forming mold 133 after being heated twice. Therefore, the first heating serves as so-called "preheating", and the second heating serves as so-called "main heating", thereby sufficiently softening the packaging sheet 3 for forming the recess 31. The hot plate 131 and the receiving part 132 are not necessarily formed to have the dimension of two packages (equivalent to two recesses 31) in the longitudinal direction. If the packaging sheet 3 is sufficiently softened by heating once, the hot plate 131 and the receiving part 132 may be formed to have a dimension of one package (equivalent to one recess 31) in the longitudinal direction. If the packaging sheet 3 is not sufficiently softened by heating twice, the hot plate 131 and the receiving part 132 may be formed to have a dimension of three packages (equivalent to three recesses 31) or more in the longitudinal direction.

The forming mold 133 is located on the downstream side of the hot plate 131 and the receiving part 132 in the sheet conveying direction. The forming mold 133 includes a female mold 133*a* located below the conveyed packaging sheet 3, and a male mold 133*b* and a holding plate 133*c* located thereabove. The female mold 133*a* and the male mold 133*b* are formed to have a shape corresponding to the recess 31 so as to be capable of forming the recess 31 having desired diameter and dimension. The recess 31 formed in this embodiment has a circular cross-sectional shape with a diameter dimension decreasing as it advances downward, as shown in the figure. A plurality of suction holes (not shown) are formed on the recessed molding surface of the female mold 133*a*.

The female mold 133*a*, the male mold 133*b*, and the holding plate 133*c* are configured to be capable of moving close to and away from the packaging sheet 3 by being driven by an electric motor. The driving source to drive the female mold 133*a*, the male mold 133*b*, and the holding plate 133*c* is not limited to the electric motor. The driving source of the female mold 133*a*, the male mold 133*b*, and the holding plate 133*c* may be any device that can cause the female mold 133*a*, the male mold 133*b*, and the holding mold 133*c* to move close to and away from the packaging sheet 3. The driving source of the female mold 133*a*, the male mold 133*b*, and the holding plate 133*c* may be, for example, an air cylinder or a hydraulic cylinder.

The male mold 133*b* and the holding plate 133*c* move close to the female mold 133*a* so as to sandwich the packaging sheet 3 softened by the hot plate 131. While the packaging sheet 3 is interposed between the female mold 133*a* and the holding plate 133*c*, air is suctioned through the plurality of suction holes, thereby forming the recess 31 recessed downward in the packaging sheet 3. In such a state, the male mold 133*b* is further fitted into the female mold 133*a*, thereby reliably forming the recess 31 having a desired shape. The male mold 133*b* is not necessarily provided. If the recess 31 having a desired shape can be formed by suctioning air through the plurality of suction holes of the female mold 133*a*, the male mold 133*b* may be omitted.

The forming mold 133 of this embodiment is provided as one set, so that one recess 31 is formed at a time (with one cycle of vertical movement of the female mold 133*a* and the male mold 133*b*), but a plurality of recesses 31 can be formed at a time by arranging plural sets of forming molds 133 in parallel along the longitudinal direction of the packaging sheet 3 or the width direction of the packaging sheet 3 (the front-back direction in FIG. 1).

The medicine feeder body 14 temporarily stores the medicine M and feeds the medicine M to the medicine passage 15 according to the prescription data (for example, for each dose). The medicine feeder body 14 has a storage 141 configured to temporarily store the medicine M, and can selectively feed the medicine M from the storage 141 according to the control by the control unit (not shown). Examples of the storage 141 for tablets include a storage cassette and a distribution cell in which a plurality of recesses are arranged in the form of a matrix. Further, examples of the storage 141 for powder include a cell unit including recesses having a V-shaped vertical cross section and a disk-shaped powder dispensing apparatus configured to scrape the powder according to the prescription data. However, the medicine feeder body 14 is not limited to the aforementioned embodiments and can be implemented by various embodiments. The storage 141 can be constituted, for example, by a plurality of per-type storages configured to store the medicine M for each type or a plurality of per-dose storages configured to store the medicine M for each dose. In this case, the medicine feeder body 14 can store the medicine M for each type or for each dose in a state that is suitable for feeding the medicine M. In the case of storing the medicine M for each type using the per-type storages, refilling with the medicine M can be facilitated. Further, in the case of storing the medicine M for each dose using the per-dose storages, the medicine M can be fed to the medicine passage 15 as it is stored.

The medicine feeder body 14 of this embodiment can handle medicine in various dosage forms. For example, tablets, capsules, and powders can be mentioned. Further, this embodiment is configured to handle only solid medicine, but it is also possible to handle medicine in liquid or gel form depending on the circumstances.

Figure 2:
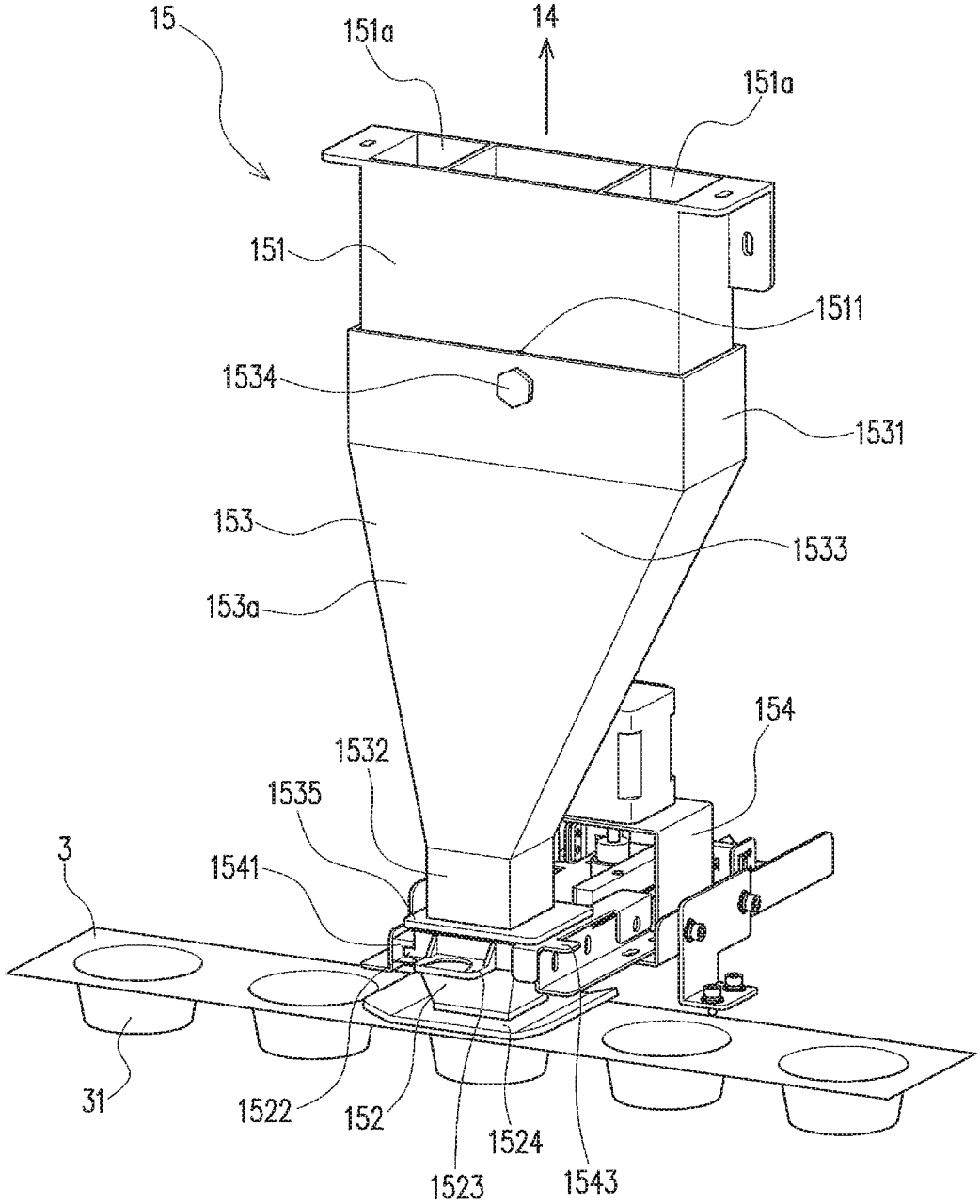
FIG. 2 is a perspective view showing a medicine passage (medicine passing apparatus) of the medicine packaging apparatus.

The medicine passage 15 serving as the medicine passing apparatus allows medicine to pass therethrough and puts the medicine M into each recess 31 formed in the packaging sheet 3 by the recess former 13. The medicine passage 15 constitutes a medicine feeding apparatus 1X (shown by the dashed-double-dotted lines in FIG. 1) by being combined with the medicine feeder body 14. The medicine passage 15 of this embodiment is configured as a hopper having an upwardly expanding shape, as its schematic shape is shown in FIG. 1 and its detailed shape is shown in FIG. 2, and is located below the medicine feeder body 14. The detailed configuration of the medicine passage 15 will be described below.

The cover sheet holder 16 holds the cover sheet 4 that is flat. As the cover sheet 4 of this embodiment, a resin sheet is used. The cover sheet 4 has a strip shape and is held by the cover sheet holder 16 so as to be drawable while being wound into a rolled body 4*a*. The cover sheet 4 has a width so as to be capable of covering the openings of the recesses 31 formed in the packaging sheet 3. The width of the cover sheet 4 of this embodiment is the same as the width of the packaging sheet 3. As the cover sheet 4, paper also can be used. The paper may be coated with resin.

The cover sheet feeder 17 feeds the cover sheet 4 configured to close the openings of the recesses 31 to the packaging sheet 3 in which the recesses 31 have been formed and the medicine M has been put into the respective recesses 31. The cover sheet feeder 17 feeds the cover sheet 4 onto the upper surface of the packaging sheet 3. In this embodiment, the cover sheet feeder 17 feeds the cover sheet 4 to the packaging sheet 3 from above. The cover sheet feeder 17 may feed the cover sheet 4 from a lateral side of the packaging sheet 3 or may feed the cover sheet 4 from below. The cover sheet feeder 17 takes the cover sheet 4 out of the cover sheet holder 16 and feeds the cover sheet 4 in the longitudinal direction. The cover sheet 4 is fed while the tension is adjusted by a plurality of rollers 171 as shown in the figure. The cover sheet 4 is drawn by a transport device (not shown) provided immediately upstream of the cutter 19, which will be described below. Therefore, the cover sheet 4 is taken out of the cover sheet holder 16. In this embodiment, the packaging sheet 3 and the cover sheet 4 are drawn by a common transport device. The feeding is stopped when the cover sheet 4 is bonded to the packaging sheet 3 by the cover sheet bonding unit 18, which will be described below. Therefore, the feeding is intermittently carried out. This intermittent feeding of the cover sheet 4 is synchronized with the feeding of the packaging sheet 3. As a device for taking out the cover sheet 4, a device, for example, configured to sandwich and draw the cover sheet 4 can be employed, and various devices such as rollers, arms, and rubber plates can be employed.

The cover sheet bonding unit 18 bonds the cover sheet 4 fed by the cover sheet feeder 17 to the packaging sheet 3 in the state where the openings of the recesses 31 are covered to be closed by the cover sheet 4. The cover sheet bonding unit 18 includes a hot plate 181 and a receiving part 182. The hot plate 181 and the receiving part 182 are opposed to each other while the conveyed cover sheet 4 and the portion of the packaging sheet 3 where the recesses 31 are not formed are interposed therebetween, and their opposed surfaces are flat.

The hot plate 181 is located above the cover sheet 4, and the receiving part 182 is located therebelow. A heater is incorporated in the hot plate 181. The receiving part 182 is made of resin and is made of rubber in this embodiment. The receiving part 182 may serve as another hot plate in which a heater is incorporated. The hot plate 181 and the receiving part 182 are configured to be capable of moving close to and away from the cover sheet 4 and the packaging sheet 3 by being driven by an electric motor. The driving source to drive the hot plate 181 and the receiving part 182 is not limited to the electric motor. The driving source of the hot plate 181 and the receiving part 182 may be any device that can cause the hot plate 181 and the receiving part 182 to move close to and away from the cover sheet 4 and the packaging sheet 3. The driving source of the hot plate 181 and the receiving part 182 may be, for example, an air cylinder or a hydraulic cylinder. Though not shown, a recessed portion into which the recess 31 is fitted is formed in the receiving part 182, so as to prevent the receiving part 182 and the recesses 31 from interfering with each other. In this embodiment, a circular hole passes through the center of the receiving part 182 as the recessed portion, so that the receiving part 182 does not interfere with the recess 31 when the receiving part 182 moves upward. The hot plate 181 and the receiving part 182 sandwich the cover sheet 4 and the packaging sheet 3 while the hot plate 181 is heated, thereby bonding (heat sealing) the cover sheet 4 to the packaging sheet 3, so that the medicine packages P are formed. This bonding prevents the medicine M put into the recesses 31 from leaking from the recesses 31. In the case where paper is used as the cover sheet 4, the cover sheet bonding unit 18 can perform the bonding while an adhesive is interposed between the cover sheet 4 and the packaging sheet 3.

While the cover sheet 4 is bonded to the packaging sheet 3, the cutter 19 cuts the two sheets 3 and 4 together for each dose or multiple doses. The cutter 19 of this embodiment includes cutting blades 191 that are located above and below the packaging sheet 3 and are movable so that their blade tips overlap each other. The medicine packages P are thus cut into a separate unit that is easy for patients to take. Therefore, the medicine packages P in the unit of each dose or multiple doses can be obtained.

It is also possible to form perforations through the packaging sheet 3 and the cover sheet 4 by changing the shape of the cutting blades 191. Such formation of perforations enables patients to appropriately cut the medicine packages P according to the convenience of patients, and therefore the patient usability is improved when taking a medicine or storing the medicine packages P. Other than such perforations, it is also possible to form a fragile portion with reduced rigidity or reduced sheet thickness as compared to other portions, so as to help patients cut the medicine packages P.

The printer 20 prints information corresponding to the prescription data on the cover sheet 4. The printer 20 can perform printing as a series of steps and thus can facilitate forming the medicine packages P into a state ready to be delivered to patients. Examples of print contents include the patient name, the date and/or the day of the week for dosing, and the timing of dosing (such as after meals, before meals, and between meals). In this embodiment, the printing is performed on the cover sheet 4 before being bonded to the packaging sheet 3. Therefore, the printer 20 is located above the conveyance line of the packaging sheet 3. It is also possible to perform the printing on the cover sheet 4 after being bonded to the packaging sheet 3. As a printing method, a thermal transfer method using an ink ribbon can be mentioned, but various methods such as an ink jet method can be employed.

Figure 3:
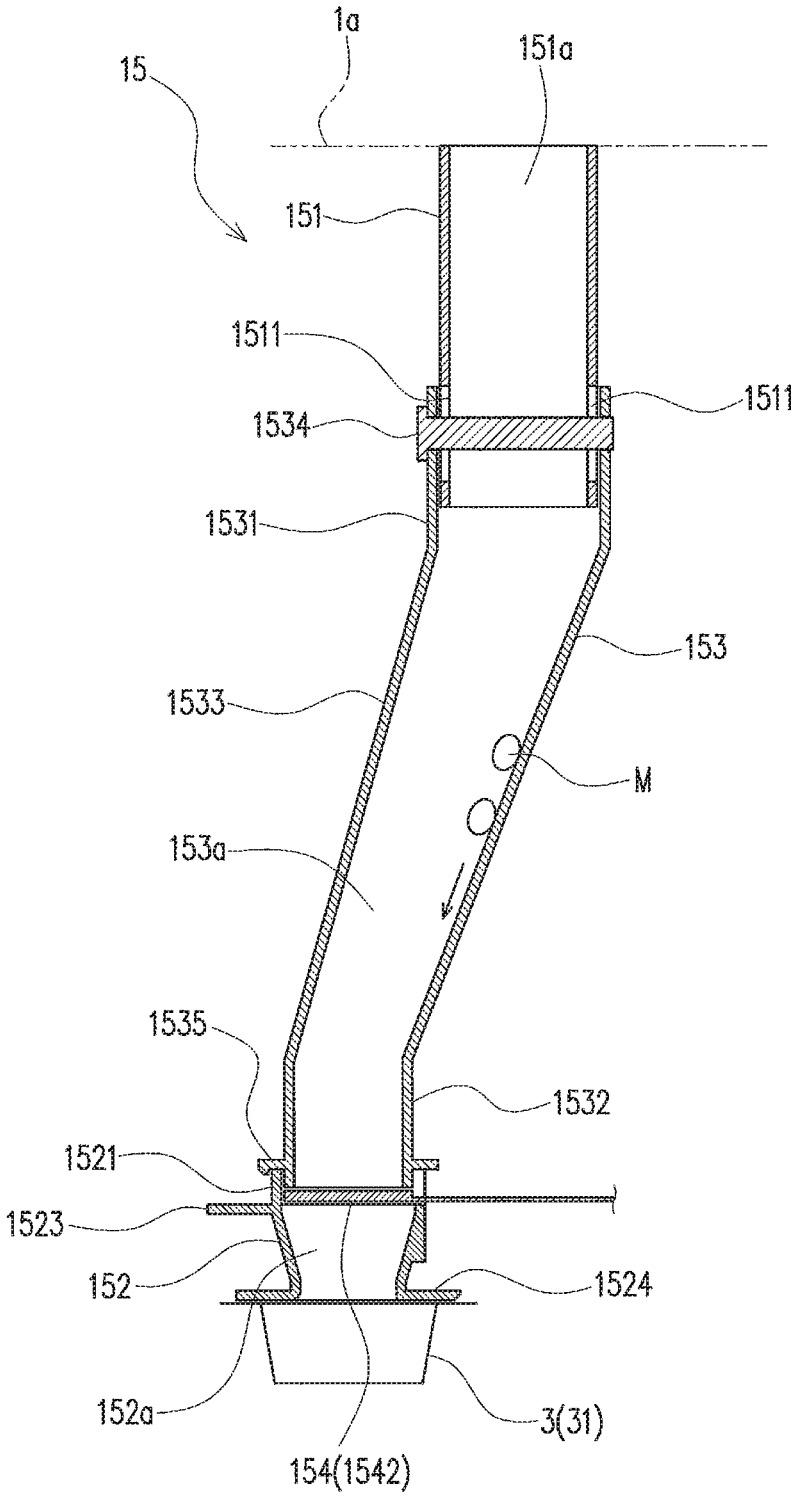
FIG. 3 is a vertical sectional view in the front-rear direction showing the medicine passage of the medicine packaging apparatus.
Figure 4:
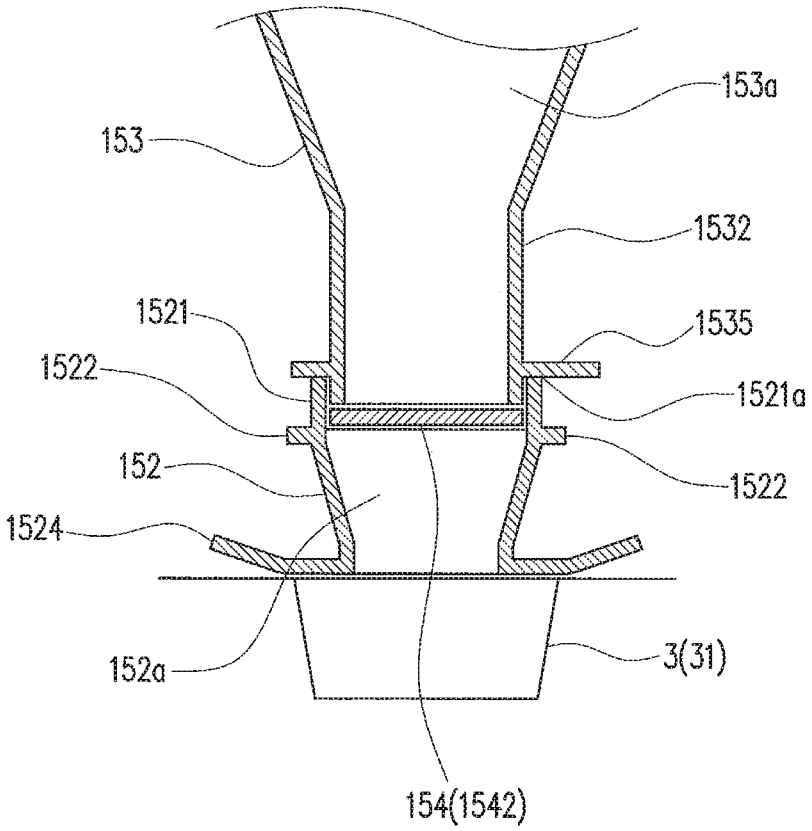
FIG. 4 is a vertical sectional view in a direction along the sheet conveying direction showing the lower part of the medicine passage of the medicine packaging apparatus.

Next, the medicine passage 15 will be described. As shown in FIG. 2, the medicine passage 15 of this embodiment includes an inlet 151, a communication part 153, and an outlet 152, sequentially from the top. The inlet 151, the communication part 153, and the outlet 152 are formed as separate bodies from each other. As shown in FIG. 3 and FIG. 4, an opening and closing mechanism 154 is located so that an opening and closing plate 1542 is interposed between the communication part 153 and the outlet 152.

The inlet 151 is arranged below the medicine feeder body 14 by being fixed to part of the structural material of the medicine packaging apparatus 1 (shown by the dashed-double-dotted line in FIG. 3) by screwing or the like. The inlet 151 is a part that is configured to allow the medicine M fed by the medicine feeder body 14 to enter from above therethrough. Two rows of medicine passages 151*a* that pass through the inlet 151 in the vertical direction and is configured to allow the medicine M to fall down are formed at both ends in the sheet conveying direction of the inlet 151. Each of the medicine passages 151*a* has a substantially square cross-sectional shape. The cross-sectional shape of the medicine passage 151*a* is not limited to the substantially square shape and may be an elliptical shape or a circular shape, for example. Further, the formation number and arrangement of the medicine passages 151*a* in the inlet 151 are not limited to those in this embodiment, and only one row or three rows or more can be provided. Further, the medicine passages 151*a* also can be provided asymmetrically in the sheet conveying direction, for example. Elongated holes 1511 extending in the vertical direction are formed in front of and behind (left and right in FIG. 3) the lower part of the inlet 151.

The outlet 152 is a part that is arranged below the inlet 151 and above the packaging sheet 3 in which the plurality of recesses 31 are formed and is configured to allow the medicine M fed by the medicine feeder body 14 to exit downward therethrough. The medicine passage 152*a* that passes through the outlet 152 in the vertical direction and is configured to allow the medicine M to fall down is formed in the outlet 152. The medicine passage 152*a* has a substantially square cross-sectional shape which is narrowed as it advances downward. The cross-sectional shape of the medicine passage 152*a* is not limited to the substantially square shape and may be an elliptical shape or a circular shape, for example. The cross-sectional shape of the medicine passage 152*a* is not necessarily narrowed as it advances downward, and may expand or stay constant as it advances downward.

The outlet 152 is detachably attached to a specific position in the upper part of the packaging sheet 3, independently of the communication part 153. Specifically, as shown in FIG. 4, the outlet 152 can be attached to or detached from the opening and closing mechanism 154 by inserting or removing a pair of laterally projecting support projections 1522 into or from a pair of recessed grooves 1541 that are formed in the opening and closing mechanism 154 and extend in the front-rear direction. Therefore, the outlet 152 can be attached to or detached from the medicine passage 15, with the communication part 153 remaining on the medicine passage 15. Accordingly, the attachment and detachment works of the outlet 152 can be facilitated. For the attachment and detachment, a handle 1523 that can be caught by hand of the operator projects in front of the outlet 152. Further, a lifting lever 1543 configured to facilitate lifting up a projection 1535 of the communication part 153 at the time of the attachment and detachment is provided in the opening and closing mechanism 154. Then, the lower end of the outlet 152 is arranged at a specific distance from the upper surface of the packaging sheet 3. Therefore, the outlet 152 does not interfere with the conveyed packaging sheet 3.

A holding unit 1524 having a plate shape is formed at the lower end of the outlet 152. The holding unit 1524 can reliably guide the medicine M to the recess 31, without leakage of the medicine M falling down from the outlet 152 through the gap between the outlet 152 and the packaging sheet 3, by covering the recess 31 in the packaging sheet 3 located immediately below the outlet 152. At least the upstream end in the sheet conveying direction of the holding unit 1524 has an upwardly warped shape (in this embodiment, the same applies also to the downstream end in the sheet conveying direction). Therefore, when the packaging sheet 3 is located below the outlet 152 before starting the operation of the medicine packaging apparatus 1, the packaging sheet 3 is less likely to be caught by the outlet 152, so that the operation can be smoothly performed.

The communication part 153 is a part communicating the inlet 151 and the outlet 152 with each other. The medicine passage 153*a* that passes through the communication part 153 in the vertical direction and is configured to allow the medicine M to fall down is formed in the communication part 153. Therefore, the upper part of the medicine passage 153*a* is in communication with the medicine passages 151*a* of the inlet 151 and the lower part of the medicine passage 153*a* is in communication with the medicine passage 152*a* of the outlet 152. In the upper part, the medicine passage 153*a* has a rectangular cross-sectional shape that is elongated along the sheet conveying direction. The long side dimension of the rectangular shape of the medicine passage 153*a* decreases as it advances downward, and the cross-sectional shape in the lower part is a substantially square shape. The cross-sectional shape of the medicine passage 153*a* is not limited to the rectangular shape or the square shape and may be an elliptical shape or a circular shape, for example. The cross-sectional shape of the medicine passage 153*a* is not necessarily narrowed as it advances downward, and may expand or stay constant as it advances downward. The communication part 153 includes an upper part 1531, a lower part 1532, and a middle part 1533.

As shown in FIG. 2 and FIG. 3, the lower end part of the inlet 151 is inserted into the upper part 1531 in the perpendicular direction, so that the upper part 1531 is loosely fitted to the inlet 151 from the outside so as to be connected. Due to the loose fitting from the outside, the gap between the communication part 153 and the inlet 151 is open to the outside of the medicine passage 15 above the lower end of the inlet 151, as shown in FIG. 3. Therefore, it is possible to prevent the medicine M from leaking through the gap between the communication part 153 and the inlet 151. Further, in the connecting portion between the inlet 151 and the communication part 153, the medicine passage 153*a* of the communication part 153 is located outwardly of both ends in the sheet conveying direction of the medicine passages 151*a* of the inlet 151. Therefore, it is possible to prevent the medicine M from being caught by the connecting portion.

Meanwhile, the lower part 1532 is loosely fitted to the outlet 152 from the inside so as to be connected by being inserted into an upper part 1521 of the outlet 152 in the perpendicular direction. Due to the loose fitting from the inside, the gap between the communication part 153 and the outlet 152 is open to the outside of the medicine passage 15 above the lower end of the communication part 153, as shown in FIG. 3. Therefore, it is possible to prevent the medicine M from leaking through the gap between the communication part 153 and the outlet 152. Further, in the connecting portion between the communication part 153 and the outlet 152, the medicine passage 152*a* of the outlet 152 is located outwardly of the medicine passage 153*a* of the communication part 153. Therefore, it is possible to prevent the medicine M from being caught by the connecting portion. Accordingly, it is possible to prevent the medicine M from being caught not only by the medicine passage 15 but also by the connecting portion between the inlet 151 and the communication part 153.

The middle part 1533 is a part configured to couple the upper part 1531 and the lower part 1532 integrally. In the medicine passage 15 of this embodiment, the outlet 152 is located forward of the inlet 151 (on the left in FIG. 3), and therefore the middle part 1533 is formed to be located more forward as it advances downward.

As shown in FIG. 3, while the communication part 153 is connected to the inlet 151, a fixing bolt 1534 passes therethrough in the front-rear direction. The fixing bolt 1534 of this embodiment passes through the center in the sheet conveying direction of the inlet 151 so as not to cross the medicine passages 151*a*. Thereby, the communication part 153 is hung from the inlet 151. Therefore, it is possible to prevent the communication part 153 from falling down, even if the outlet 152 is detached from the medicine passage 15 and the support of the communication part 153 from below is lost. As described above, the communication part 153 is loosely fitted to the inlet 151 so as to be connected. The fixing bolt 1534 passes through an elongated hole 1511 of the inlet 151. Therefore, the communication part 153 is vertically movable in the range in which the elongated hole 1511 is formed in the vertical direction. When the communication part 153 is moved upwardly, the lower end of the lower part 1532 separates from the upper part 1521 of the outlet 152, and therefore the communication part 153 is disengaged from the outlet 152. Thus, the communication part 153 is detachably attached to the outlet 152 in the lower part 1532 and may be disengaged from the outlet 152 only by moving the communication part 153 upwardly. Further, the communication part 153 is connected to the inlet 151 and the outlet 152 so as to be positionally adjustable.

The projection 1535 projects outwardly from the lower part 1532 in the form of a flange. The projection 1535 abuts an upper end face 1521*a* of the outlet 152 (see FIG. 4), and the communication part 153 is thereby connected to the outlet 152 while being supported by the outlet 152 from below in an area within the vertically movable range of the medicine passage 15. Therefore, the self-weight of the communication part 153 is applied to the outlet 152. The positional relationship among the inlet 151, the outlet 152, and the communication part 153 can be maintained by the self-weight of the communication part 153. Accordingly, the configuration to maintain the positional relationship can be simplified.

The opening and closing mechanism 154 includes the opening and closing plate 1542 configured to move in the front-rear direction. The opening and closing plate 1542 controls the input of the medicine M into the recess 31 formed in the packaging sheet 3 by crossing between the medicine passage 153*a* in the communication part 153 and the medicine passage 152*a* in the outlet 152, so as to open and close the space communicating the communication part 153 and the outlet 152 with each other.

According to the medicine packaging apparatus 1 of this embodiment configured as above, the feeding of the packaging sheet 3, the formation of the plurality of recesses 31, and the input of the medicine M can be automatically performed. Therefore, blister packaging can be easily performed.

In particular, the inlet 151 and the outlet 152 are provided in the medicine passage 15 as separate bodies from each other. Therefore, the adjustment work for the inlet 151 and the adjustment work for the outlet 152 can be individually performed. In the case where the inlet 151 and the outlet 152 are integrally provided, it is necessary to adjust the positions of the inlet 151 and the outlet 152 at the same time so that both the gap between the inlet 151 and the medicine feeder body 14 and the gap between the outlet 152 and the packaging sheet 3 fall within acceptable ranges. In contrast, according to the example of the aforementioned configuration, the positions of the inlet 151 and the outlet 152 can be individually adjusted. Accordingly, as compared with the case where the respective adjustment works need to be performed at the same time, the adjustment works can be facilitated.

Further, the communication part 153 is provided in the medicine passage 15 as a separate body from the inlet 151 and the outlet 152 and is connected to the inlet 151 and the outlet 152 so as to be positionally adjustable. Therefore, even if the relative position and posture of the inlet 151 and the outlet 152 change due to the adjustment works, the change can be absorbed. Such absorption of the change eliminates the need to strictly adjust the gap between the communication part 153 and the inlet 151 and the need to strictly adjust the gap between the communication part 153 and the outlet 152. Accordingly, the adjustment work for the communication part 153 can be omitted. In this way, the adjustment works for the inlet 151 and the outlet 152 can be facilitated, and the adjustment work for the communication part 153 can be omitted. Accordingly, the time and labor required for the works to adjust the distances among a plurality of components of the medicine passage 15 can be reduced in this embodiment. The communication part 153 may be connected to at least one of the inlet 151 and the outlet 152 so as to be positionally adjustable according to the change in the relative position and the posture of the inlet 151 and the outlet 152.

Finally, the configurations and operations of the aforementioned embodiments (including the modifications) will be summarized. The medicine feeding apparatus 1X according to the aforementioned embodiment includes: a medicine feeder body 14 configured to feed medicine M; and a medicine passage 15 configured to guide the medicine M fed by the medicine feeder body 14 to a packaging material 3 configured to package the medicine M, wherein the medicine passage 15 includes: an inlet 151 that is arranged below the medicine feeder body 14 and is configured to allow the medicine M fed by the medicine feeder body 14 to enter from above therethrough; an outlet 152 that is arranged below the inlet 151 and above the packaging material 3 and is configured to allow the medicine M fed by the medicine feeder body 14 to exit downward therethrough; and a communication part 153 that is configured to communicate the inlet 151 and the outlet 152 with each other, the inlet 151 and the outlet 152 are provided as separate bodies from each other, and the communication part 153 is provided as a separate body from the inlet 151 and the outlet 152 and is connected to the inlet 151 and the outlet 152 so as to be positionally adjustable.

According to the example of the aforementioned configuration, the medicine M is fed by the medicine feeder body 14. The medicine M fed by the medicine feeder body 14 is guided by the medicine passage 15 to the packaging material 3 configured to package the medicine M. In the medicine passage 15, the outlet 152 is arranged below the inlet 151, and the inlet 151 and the outlet 152 are communicated with each other by the communication part 153. The medicine M fed by the medicine feeder body 14 enters the inlet 151 from above, passes through the communication part 153, and exits through the outlet 152 downward. The inlet 151 and the outlet 152 are provided as separate bodies from each other. Therefore, the adjustment work for the inlet 151 and the adjustment work for the outlet 152 can be performed individually. The adjustment work for the inlet 151 is the work to adjust the gap between the inlet 151 and the medicine feeder body 14. The adjustment work for the outlet 152 is the work to adjust the gap between the outlet 152 and the packaging material 3. In the case where the inlet 151 and the outlet 152 are integrally provided, it is necessary to adjust the positions of the inlet 151 and the outlet 152 at the same time so that both the gap between the inlet 151 and the medicine feeder body 14 and the gap between the outlet 152 and the packaging sheet 3 fall within acceptable ranges. In contrast, according to the example of the aforementioned configuration, the positions of the inlet 151 and the outlet 152 can be individually adjusted. Accordingly, as compared with the case where the respective adjustment works need to be performed at the same time, the adjustment works can be facilitated. The communication part is provided as a separate body from the inlet 151 and the outlet 152 and is connected to the inlet 151 and the outlet 152 so as to be positionally adjustable. Therefore, even if the relative position and posture of the inlet 151 and the outlet 152 change due to the adjustment works, the change can be absorbed. Such absorption of the change eliminates the need to strictly adjust the gap between the communication part 153 and the inlet 151 and the need to strictly adjust the gap between the communication part 153 and the outlet 152. Accordingly, the adjustment work for the communication part 153 can be omitted. In this way, the adjustment works for the inlet 151 and the outlet 152 can be facilitated, and the adjustment work for the communication part 153 can be omitted. Accordingly, the time and labor required for the works to adjust the distances between a plurality of components of the medicine passage 15 can be reduced.

A medicine passing apparatus 15 according to an example of the configuration of this embodiment is the medicine passing apparatus 15 through which medicine M passes, the medicine passing apparatus 15 including: an inlet 151 that is configured to allow the medicine M fed by the medicine feeder body 14 to enter from above; an outlet 152 that is arranged below the inlet 151 and is configured to allow the medicine M to exit downward therethrough; and a communication part 153 that is configured to communicate the inlet 151 and the outlet 152 with each other, wherein the inlet 151 and the outlet 152 are provided as separate bodies from each other, and the communication part 153 is provided as a separate body from the inlet 151 and the outlet 152 and is connected to the inlet 151 and the outlet 152 so as to be positionally adjustable.

According to the example of the aforementioned configuration, the outlet 152 is arranged below the inlet 151, and the inlet 151 and the outlet 152 are communicated with each other by the communication part 153. The medicine M enters the inlet 151 from above, passes through the communication part 153, and exits through the outlet 152 downward. The inlet 151 and the outlet 152 are provided as separate bodies from each other. Therefore, the adjustment work for the inlet 151 and the adjustment work for the outlet 152 can be performed individually. Accordingly, as compared with the case where the respective adjustment works need to be performed at the same time, the adjustment works can be facilitated. The adjustment work for the inlet 151 is the work to adjust the gap between the inlet 151 and an object that provides the medicine M to the inlet 151. The adjustment work for the outlet 152 is the work to adjust the gap between the outlet 152 and an object to which the medicine M is provided from the outlet 152. The communication part 153 is provided as a separate body from the inlet 151 and the outlet 152 and is connected to the inlet 151 and the outlet 152 so as to be positionally adjustable. Therefore, even if the relative position and posture of the inlet 151 and the outlet 152 change due to the adjustment works, the change can be absorbed. Such absorption of the change eliminates the need to strictly adjust the gap between the communication part 153 and the inlet 151 and the need to strictly adjust the gap between the communication part 153 and the outlet 152. Accordingly, the adjustment work for the communication part 153 can be omitted. In this way, the adjustment works for the inlet 151 and the outlet 152 can be facilitated, and the adjustment work for the communication part 153 can be omitted. Accordingly, the time and labor required for the works to adjust the distances among a plurality of components can be reduced.

Further, the configuration can be such that the communication part 153 is vertically movable and is connected to the outlet 152 while being supported from below by the outlet 152 in an area within the vertically movable range.

According to the example of the aforementioned configuration, the communication part 153 is vertically movable and is connected to the outlet while being supported by the outlet from below by the outlet in an area within the vertically movable range. Therefore, the positional relationship among the inlet 151, the outlet 152, and the communication part 153 can be maintained by using the self-weight of the communication part 153 applied to the outlet 152. Accordingly, the configuration to maintain the positional relationship can be simplified.

Further, the configuration can be such that the communication part 153 is hung from the inlet 151.

According to the example of the aforementioned configuration, the communication part 153 is hung from the inlet 151. Therefore, even if the outlet 152 is detached, it is possible to prevent the communication part 153 from falling down.

Further, the configuration can be such that the communication part 153 is detachably attached to the outlet 152, and the outlet 152 is detachably attached to a specific position above the packaging material 3 independently of the communication part 153.

According to the example of the aforementioned configuration, the communication part 153 is detachably attached to the outlet 152. Further, the outlet 152 is detachably attached to a specific position above the packaging material 3 independently of the communication part 153. Therefore, the outlet 152 can be detached while leaving the communication part 153. Accordingly, the attachment and detachment work of the outlet 152 can be facilitated.

Further, the configuration can be such that the communication part 153 is loosely fitted to the inlet 151 from the outside so as to be connected and is loosely fitted to the outlet 152 from the inside so as to be connected.

According to the example of the aforementioned configuration, the communication part 153 is loosely fitted to the inlet 151 from the outside so as to be connected. Therefore, it is possible to prevent the medicine M from leaking through the gap between the communication part 153 and the inlet 151. Further, the communication part 153 is loosely fitted to the outlet 152 from the inside so as to be connected. Therefore, it is possible to prevent the medicine M from leaking through the gap between the communication part 153 and the outlet 152. Accordingly, it is possible to prevent the medicine M from leaking from the medicine passage 15.

Further, the configuration can be such that, in the connecting portion between the inlet 151 and the communication part 153, the medicine passage of the communication part 153 is located outwardly of the medicine passage of the inlet 151, and in the connecting portion between the communication part 153 and the outlet 152, the medicine passage of the outlet 152 is located outwardly of the medicine passage of the communication part 153.

According to the example of the aforementioned configuration, in the connecting portion between the inlet 151 and the communication part 153, the medicine passage of the communication part 153 is located outwardly of the medicine passage of the inlet 151. Therefore, it is possible to prevent the medicine M from being caught by the connecting portion. In the connecting portion between the communication part 153 and the outlet 152, the medicine passage of the outlet 152 is located outwardly of the medicine passage of the communication part 153. Therefore, it is possible to prevent the medicine M from being caught by the connecting portion. Accordingly, it is possible to prevent the medicine M from being caught within the medicine passage 15.

According to the example of the aforementioned configuration, this embodiment can reduce the time and labor required for the works to adjust the distances among a plurality of components of the medicine passage 15.

Hereinbefore, an embodiment of the present invention has been described. However, the present invention is not limited to the above described embodiment, and various modifications can be made without departing from the gist of the present invention.

REFERENCE SIGNS LIST

1: Medicine packaging apparatus
1X: Medicine feeding apparatus
11: Packaging sheet holder
12: Packaging sheet feeder
13: Recess former
14: Medicine feeder body
141: Storage (per-type storage, per-dose storage)
15: Medicine passing apparatus, Medicine passage
151: Inlet
151*a*: Medicine passage of inlet
152: Outlet
152*a*: Medicine passage of outlet
153: Communication part
153*a*: Medicine passage of communication part
154: Opening and closing mechanism
16: Cover sheet holder
17: Cover sheet feeder
18: Cover sheet bonding unit
19: Cutter
20: Printer
3: Packaging material, Packaging sheet
31: Recess
4: Cover sheet
M: Medicine

The invention claimed is:

1. A medicine feeding apparatus comprising:

a medicine feeder body configured to feed medicine; and a medicine passage configured to guide the medicine fed by the medicine feeder body to a packaging material configured to package the medicine, wherein the medicine passage comprises:

a first portion;

a second portion;

an inlet that is provided in the first portion, held at a first specific position below the medicine feeder body, and is configured to allow the medicine fed by the medicine feeder body to enter from above therethrough;

an outlet that is detachably provided in the second portion, held at a second specific position below the inlet and above the packaging material in the state where the outlet is attached to the second portion, and is configured to allow the medicine fed by the medicine feeder body to exit downward therethrough; and a communication part configured to communicate the inlet and the outlet with each other, wherein the inlet and the outlet are provided as separate bodies from each other, and wherein the communication part is provided as a separate body from the inlet and the outlet, is vertically movable relative to the inlet and the outlet, is supported from below by the outlet in an area within a vertically movable range, is disengaged from the outlet only by moving upwardly, and is configured to be positionally adjusted with respect to the inlet depending on a position of the inlet with respect to the outlet only when the communication part is connected to the inlet and the outlet is attached to the second portion.

2. The medicine feeding apparatus according to claim 1, wherein the communication part is hung from the inlet.

3. The medicine feeding apparatus according to claim 1, wherein the communication part can freely move with respect to the inlet from the outside of the inlet so as to be connected and can freely move with respect to the outlet from the inside of the outlet so as to be connected.

4. The medicine feeding apparatus according to claim 1, wherein the inlet is located inwardly of the communication part in a connecting portion between the inlet and the communication part, and wherein the communication part is located inwardly of the outlet in a connecting portion between the communication part and the outlet.

5. A medicine passing apparatus configured to allow medicine to pass therethrough, the medicine passing apparatus comprising:

a first portion;

a second portion;

an inlet that is provided in the first portion, held at a first specific position configured to allow the medicine to enter from above therethrough;

an outlet that is detachably provided in the second portion, held at a second specific position below the inlet in the state where the outlet is attached to the second portion, and is configured to allow the medicine to exit downward therethrough; and a communication part that is configured to communicate the inlet and the outlet with each other, wherein the inlet and the outlet are provided as separate bodies from each other, and wherein the communication part is provided as a separate body from the inlet and the outlet, is vertically movable relative to the inlet and the outlet, is supported from below by the outlet in an area within a vertically movable range, is disengaged from the outlet only by moving upwardly, and is configured to be positionally adjusted with respect to the inlet depending on a position of the inlet with respect to the outlet only when the communication part is connected to the inlet and the outlet is attached to the second portion.

* * * * *